US009248419B2

(12) United States Patent
Matsumoto et al.

(10) Patent No.: US 9,248,419 B2
(45) Date of Patent: Feb. 2, 2016

(54) DISPERSION AND GRINDING MACHINE

(71) Applicant: ASADA IRON WORKS CO., LTD., Takatsuki-shi (JP)

(72) Inventors: Akihiko Matsumoto, Osaka (JP); Ippei Muneoka, Osaka (JP); Shinya Oda, Osaka (JP)

(73) Assignee: ASADA IRON WORKS CO., LTD. (JP)

( * ) Notice: Subject to any disclaimer, the term of this patent is extended or adjusted under 35 U.S.C. 154(b) by 0 days.

(21) Appl. No.: 14/395,948

(22) PCT Filed: Apr. 18, 2013

(86) PCT No.: PCT/JP2013/002630

§ 371 (c)(1),
(2) Date: Oct. 21, 2014

(87) PCT Pub. No.: WO2013/161229

PCT Pub. Date: Oct. 31, 2013

(65) Prior Publication Data

US 2015/0136888 A1 May 21, 2015

(30) Foreign Application Priority Data

Apr. 23, 2012 (JP) ..... 2012-097296

(51) Int. Cl.
*B02C 23/02* (2006.01)
*B01F 7/00* (2006.01)
(Continued)

(52) U.S. Cl.
CPC . *B01F 7/008* (2013.01); *B01F 3/12* (2013.01); *B01F 7/00708* (2013.01);
(Continued)

(58) Field of Classification Search
CPC ..... B02C 19/10; B02C 23/00; B02C 23/02; B01F 7/008; B01F 3/12; B01F 15/068
USPC ..... 241/244, 246, 247
See application file for complete search history.

(56) References Cited

U.S. PATENT DOCUMENTS 2,402,170 A * 6/1946 Lund ..... B02C 2/10 241/246
3,386,131 A 6/1968 Vanzo
(Continued)

FOREIGN PATENT DOCUMENTS

DE 3327137 2/1984
JP 53-24329 3/1978
(Continued)

OTHER PUBLICATIONS

Japanese Patent Appl. No. 2014-512334—Office Action issued on Jan. 20, 2015.
(Continued)

*Primary Examiner* — Faye Francis
(74) *Attorney, Agent, or Firm* — Gerald E. Hespos; Michael J. Porco; Matthew T. Hespos

(57) ABSTRACT

The present invention can suppress variations in dispersion and grinding processing, apply stable shearing force to a material to be processed, and also enable efficient dispersion and grinding. The present invention has a supply portion (10A), a processing portion (10B), and a discharge portion (10C). The processing portion (10B) includes a stator (12*b*), and a rotor (11*b*). The material to be processed is processed in a gap (Gt) between an outer peripheral surface of the rotor (11*b*) and an inner peripheral surface of the stator (12*b*). The inner peripheral surface of the stator (12*b*) and the outer peripheral surface of the rotor (11*b*) are circular in a cross section orthogonally intersecting the axis of the rotor (11*b*) and linear in a cross section bearing the axis. The gap (Gt) is constant in the circumferential direction and the axial direction.

10 Claims, 5 Drawing Sheets

(51) Int. Cl.

| | |
|---|---|
| ***B02C 19/10*** | (2006.01) |
| ***B01F 15/06*** | (2006.01) |
| ***B02C 19/22*** | (2006.01) |
| ***B01F 3/12*** | (2006.01) |

(52) U.S. Cl.
CPC ..... *B01F 15/065* (2013.01); *B01F 15/068* (2013.01); *B02C 19/10* (2013.01); *B02C 19/22* (2013.01); *B02C 23/02* (2013.01)

(56) References Cited

U.S. PATENT DOCUMENTS

| | | | | |
|---|---|---|---|---|
| 3,841,465 | A * | 10/1974 | Miller, Jr. ..... | F23G 5/444 162/18 |
| 5,370,824 | A | 12/1994 | Nagano et al. | |
| 5,816,697 | A | 10/1998 | Nogata et al. | |
| 7,291,001 | B2 * | 11/2007 | Bacher ..... | B01F 7/163 241/186.5 |
| 7,531,126 | B2 * | 5/2009 | Oh ..... | B01J 8/082 241/186.5 |
| 2004/0013587 | A1 | 1/2004 | Holl et al. | |
| 2004/0154985 | A1 | 8/2004 | Shekunov et al. | |
| 2007/0104021 | A1 | 5/2007 | Okabe et al. | |
| 2008/0197218 | A1 | 8/2008 | Ishigaki et al. | |
| 2010/0307601 | A1 | 12/2010 | Gabriel et al. | |
| 2012/0006919 | A1 * | 1/2012 | Kelsey ..... | B02C 17/002 241/30 |

FOREIGN PATENT DOCUMENTS

| | | |
|---|---|---|
| JP | 62121627 | 6/1987 |
| JP | 6-47793 | 2/1994 |
| JP | 10-76149 | 3/1998 |
| JP | 2000-153167 | 6/2000 |
| JP | 2005-262137 | 9/2005 |
| JP | 2005262137 | 9/2005 |
| JP | 2006218436 | 8/2006 |
| JP | 2007-125518 | 5/2007 |
| JP | 2008-200601 | 9/2008 |
| JP | 2009-119317 | 6/2009 |
| JP | 2009119317 | 6/2009 |
| WO | 9411096 | 5/1994 |

OTHER PUBLICATIONS

International Search Report of Jun. 28, 2013.
European Patent Appl. No. 13 781 253.3—Search Report issued on Apr. 16, 2015.
Korean Office Action dated Oct. 8, 2015.
Translation of Korean Office Action dated Oct. 8, 2015.

* cited by examiner

DISPERSION AND GRINDING MACHINE

TECHNICAL FIELD

The present invention relates to a dispersion and grinding machine for performing dispersion or grinding processing to a material to be processed without using a medium.

BACKGROUND ART

Various types of dispersion machines have been developed as the above-mentioned machines for performing dispersion or grinding processing. Among such dispersion machines, there is a colloid mill-type dispersion machine.

This dispersion machine includes a pair of upper and lower disk-shaped grindstones, and the upper and lower grindstones are relatively rotated with their axes aligning with each other. The granular material (material to be processed) that is supplied to a central charging part is thereby atomized in the course of being discharged to the outer periphery through a gap between the grindstones (for example, refer to Japanese Unexamined Patent Publication No. 2000-153167).

Meanwhile, with the dispersion machine of Japanese Unexamined Patent Publication No. 2000-153167, since the peripheral velocity at a portion near the axis of the grindstone is different from the peripheral velocity at a portion near the periphery in the gap between the grindstones, the shearing force applied to the material to be processed is smaller at the portion near the axis than at the portion near the periphery. Accordingly, since the material to be processed moves in a shearing force distribution having a gradient of shearing force, a difference in the shearing force that is applied to the material to be processed will arise depending on positions where the material to be processed moves, which causes a problem that variations tend to arise in the dispersion processing.

Moreover, with the dispersion machine of Japanese Unexamined Patent Publication No. 2000-153167, since there is a considerably great gradient in the shearing force distribution in the gap (dispersion region) between the upper and lower grindstones, it is difficult to apply a relatively stable shearing force to the material to be processed. In particular, there is a problem that a sufficient shearing force cannot be applied at a portion near the axis of the grindstones in the gap. In addition, with the dispersion machine of, a lower surface of the upper grindstone and an upper surface of the lower grindstone are not flat and are formed at a predetermined inclination. Thus, since the gap between both grindstones will change in the circumferential direction and the radial direction, the material to be processed in the form of a fluid existing in the gap will be seen to have changed viscosities in view of Newton's well-known viscosity equation, which causes a problem that dispersion cannot be performed efficiently.

The dispersion machine of Japanese Unexamined Patent Publication No. 2000-153167 will encounter the same situation when used for grinding a solid.

SUMMARY OF INVENTION

The present invention was devised in order to solve the foregoing problems of the conventional technologies, and an object of this invention is to provide a dispersion and grinding machine capable of suppressing variations in the dispersion or grinding processing, applying stable shearing force to a material to be processed, and also realizing efficient dispersion or grinding.

The dispersion and grinding machine according to one mode of the present invention comprises a supply portion for supplying a material to be processed, a processing portion for subjecting the material to be processed, which is supplied by the supply portion, to dispersion or grinding processing, and a discharge portion for discharging, from the processing portion, the material that has been processed by the processing portion, wherein the processing portion includes a stator having an inner cavity, and a rotor provided in the inner cavity and rotatable about an axis of the stator, and the material to be processed is processed in a gap between an outer peripheral surface of the rotor and an inner peripheral surface of the stator, the inner peripheral surface facing the outer peripheral surface of the rotor, and wherein the inner peripheral surface of the stator and the outer peripheral surface of the rotor are circular in a cross section orthogonally intersecting the axis of the rotor, and linear in a cross section bearing the axis, and the gap between the inner peripheral surface of the stator and the outer peripheral surface of the rotor is constant in the circumferential direction and the axial direction. It should be noted that the expression of "the gap is constant" is a concept that includes "substantially constant". Moreover, the expression of "cross section is circular" is a concept that includes not only "truly circular" but also "substantially circular".

In the foregoing configuration, the material to be processed can be subjected to dispersion or grinding (dispersion or grinding is hereinafter referred to as "dispersion/grinding") between the inner peripheral surface of the stator and the outer peripheral surface of the rotor. Moreover, since the gap between the stator and the rotor is constant in the circumferential direction and the axial direction, the viscosity of the material to be processed that is subject to dispersion/grinding processing can be stabilized in comparison to the conventional technologies, and efficient dispersion/grinding is enabled. Moreover, since both the inner peripheral surface of the stator and the outer peripheral surface of the rotor are linear in a cross section bearing the axis, in the case where both the inner peripheral surface of the stator and the outer peripheral surface of the rotor are parallel to the axis, a shearing force distribution that is free from any gradient of shearing force is obtainable. Otherwise, in the case where both the inner peripheral surface of the stator and the outer peripheral surface of the rotor are inclined relative to the axis, a shearing force distribution having a smaller gradient of shearing force is obtainable. Since the material to be processed moves in the foregoing shearing force distribution, an intended shearing force can be applied to the material to be processed from the initial stage of dispersion/grinding processing by adjusting the diameter of the rotor, and it is thereby possible to apply a stable shearing force to the material to be processed from the initial stage of processing. Furthermore, although the material to be processed moves in different locations, it is possible to suppress the difference in the applied shearing force, and thereby suppress variations in the dispersion/grinding processing. In addition, since the material to be processed is supplied from the supply portion to the processing portion, the supplied material is processed in the processing portion, and the discharge portion discharges the processed material, it is possible to continuously perform the dispersion/grinding processing.

DESCRIPTION OF EMBODIMENTS

An embodiment of the present invention is now described in detail.

An example of performing dispersion processing is foremost described.

Figure 1:
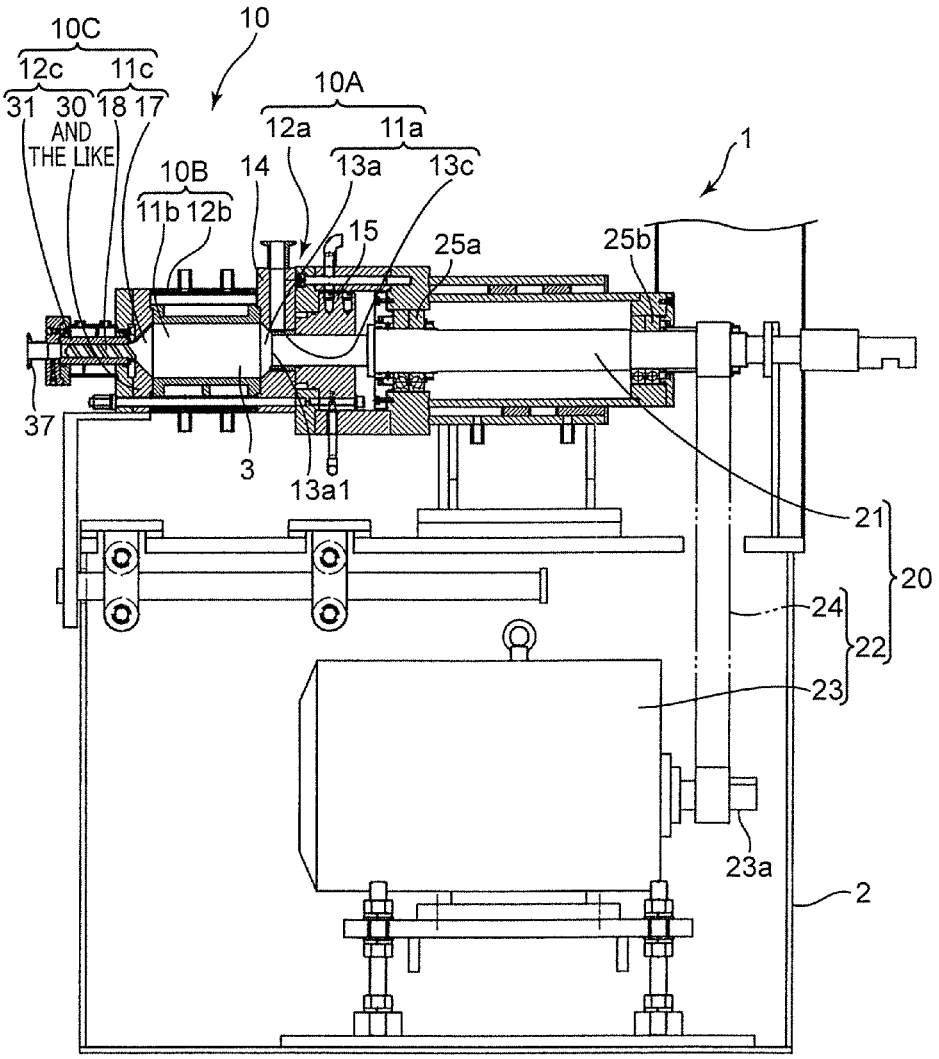
FIG. 1 is a frontal cross sectional view showing a dispersion and grinding machine according to one embodiment of the present invention.
Figure 2:
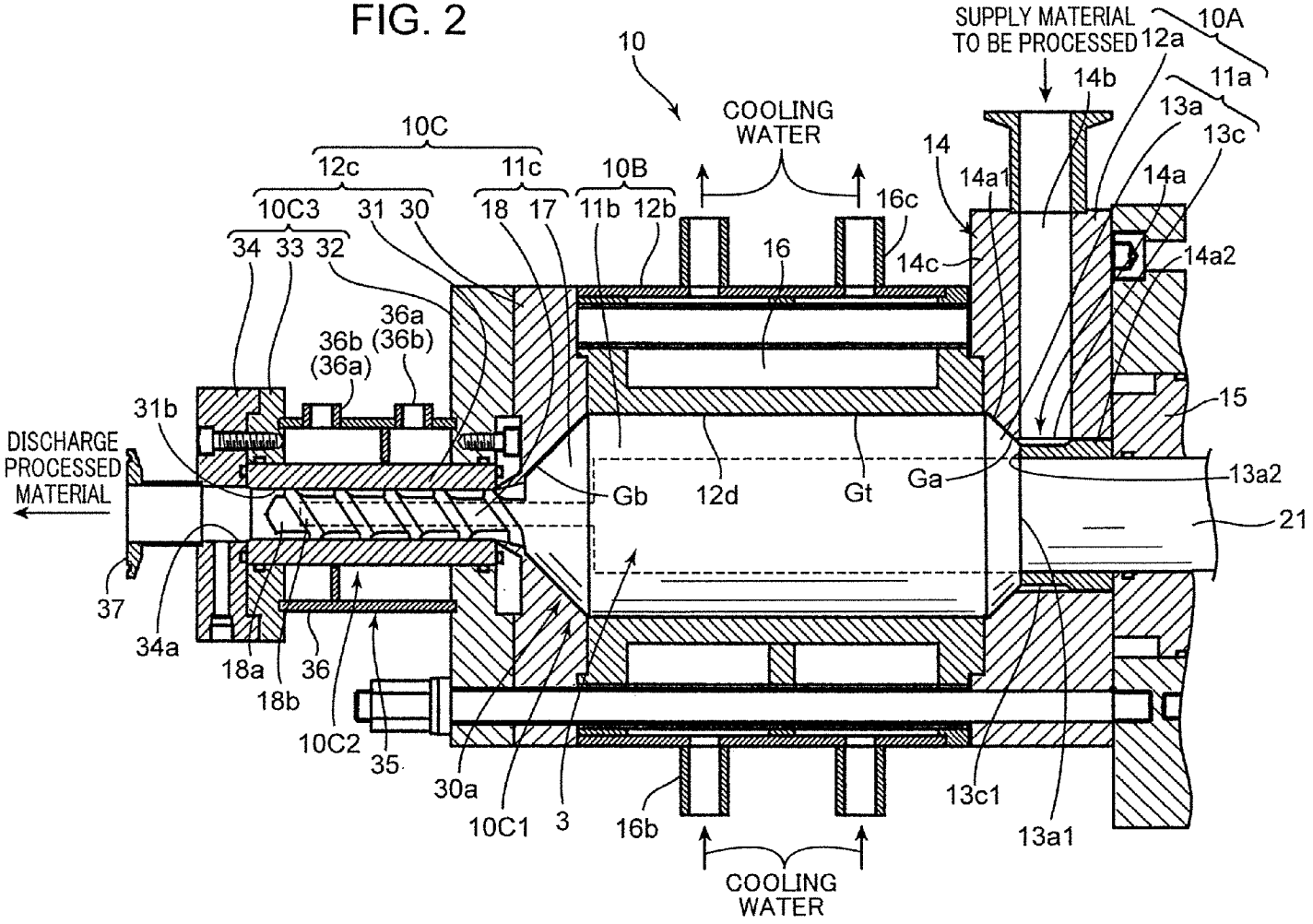
FIG. 2 is a frontal cross sectional view showing a main part of the dispersion and grinding machine illustrated in FIG. 1.

FIG. 1 is a frontal cross sectional view showing a dispersion machine according to one embodiment of the present invention, and FIG. 2 is a frontal cross sectional view showing a main part thereof. Here, the term "dispersion" means a state where one or more of two or more types of substances not combinable with one another exist uniformly in the other types of substances in the form of fine particles, and the term "grinding" means the act of pulverizing a solid into pieces.

The dispersion machine 1 comprises a base 2, a dispersion machine body 10 that is disposed on the base 2, and a driver 20 that drives the dispersion machine body 10. The dispersion machine body 10 includes, in order from one end side (right side), a supply portion 10A, a processing portion 10B and a discharge portion 10C, and the portions 10A to 10C include rotors 11*a* to 11*c* and stators 12*a* to 12*c*, respectively. In this embodiment, the respective rotors 11*a* to 11*c* of the portions 10A to 10C are provided on the outside of a rotational shaft 21, and formed with hollows (illustrated with broken lines in FIG. 2) to allow the rotational shaft 21 to be inserted therethrough, and integrated with one another with their respective axes being aligned, thereby constituting a rotary body 3 having an annular cross section.

The driver 20 includes the rotational shaft 21, and a rotating driver 22 that drivingly rotates the rotational shaft 21.

The rotating driver 22 comprises an electric motor 23, and an endless belt 24 that is placed across an output shaft 23*a* of the electric motor 23 and the rotational shaft 21. The rotational shaft 21 is turnably supported by a pair of bearing members 25*a*, 25*b*.

The supply portion 10A includes a supply portion rotor 11*a*, a supply portion stator 12*a* that surrounds the supply portion rotor 11*a*, and a seal member 15 described later, and supplies a material to be processed to a processing portion 10B under a supply pressure of the material to be processed that has been supplied to the supply portion 10A and a centrifugal force generated by the rotation of an inlet rotor 13*a* described later. The supply pressure of the material to be processed is generated, for example, by feeding the material to be processed with a screw feeder or a liquid feeding pump (neither are shown) that is connected to a supply hole 14*b* formed in the supply portion stator 12*a*. The material to be processed does not have to be forcibly fed to the supply hole 14*b* with the screw feeder or the liquid feeding pump, but may be appreciated to be supplied by a way of natural drop or other methods. In the foregoing case, the material to be processed is supplied to the processing portion 10B under the centrifugal force that is generated by the rotation of the inlet rotor 13*a*. Accordingly, the supply pressure may be specifically set, for example, between 0.0 and 0.5 MPa.

The supply portion rotor 11*a* includes the inlet rotor 13*a*, which has an annular cross section, mounted on the outside of the rotational shaft 21, and a substantially cylindrical tubular member 13*c* that is similarly mounted on the outside of the rotational shaft 21.

The inlet rotor 13*a* is formed to have a constant inner diameter, but to have a smaller outer diameter at the right side (inlet side) than at the left side (outlet side) to define a tapered shape. The outer diameter of the right end surface 13*a*1 of the inlet rotor 13*a* is made to be larger than that of the rotational shaft 21 to thereby define a stepped part 13*a*2 to the outer peripheral surface of the rotational shaft 21 (refer to FIG. 2). The tubular member 13*c* is mounted in a state where the rotational shaft 21 is inserted therethrough, and is formed with an annular recess 13*c*1 in the entire circumference of the end portion of the outer peripheral surface of the tubular member 13*c* that is closer to the stepped part 13*a*2. The bottom surface of the recess 13*c*1 and the outer peripheral edge of the right end surface 13*a*1 of the inlet rotor 13*a* are configured to have the same radius. In other words, the thickness of the part formed with the recess 13*c*1 and the extent of the stepped part 13*a*2 are made to be the same.

The supply portion stator 12*a* comprises a block-shaped stator body 14, a through-hole 14*a* formed in a center part of the stator body 14 and extending in a horizontal direction, and the supply hole 14*b* extending in a vertical direction (radial direction of the rotational shaft 21) to join the through-hole 14*a*. The inlet rotor 13*a* and the tubular member 13*c* are inserted through the through-hole 14*a*. Moreover, the supply hole 14*b* is adapted for charging the material to be processed, and extends in the vertical direction (radial direction of the rotational shaft 21) so that its lower opening joins the recess 13*c*1.

The inner peripheral surface defining the through-hole 14*a* includes a first region 14*a*1 that faces the inlet rotor 13*a*, and a second region 14*a*2 that faces the tubular member 13*c*. The first region 14*a*1 of the supply portion stator 12*a* serves as an inlet stator 14*c* that covers the inlet rotor 13*a*.

The first region 14*a*1 is formed to have a tapered shape similar to the outer peripheral surface of the inlet rotor 13*a*; specifically, the right side (inlet side) is made to have a smaller diameter than the left side (outlet side). A gap Ga for moving the material to be processed is defined over the entire circumference between the first region 14*a*1 and the outer peripheral surface of the inlet rotor 13*a*. Meanwhile, the foregoing second region 14*a*2 is formed to have a constant inner diameter, and comes into contact with the outer peripheral surface of the tubular member 13*c*; more specifically, comes into contact with the outer peripheral surface on the right side of the recess 13*c*1.

An annular seal member 15 is provided on the right side of the supply portion stator 12*a* and the tubular member 13*c*. The seal member 15 is mounted on the rotational shaft 21 in a state where the rotational shaft 21 passing through an inner cavity thereof, and prevents the material to be processed from leaking to the opposite side of the supply portion 10A via the rotational shaft 21.

With the supply portion 10A configured as described above, the lower opening of the supply hole 14*b* is in communication with the recess 13*c*1, and the material to be processed is charged from the upper opening of the supply hole 14*b*. The material to be processed having been charged in the supply hole 14*b* is introduced into the recess 13*c*1 and fed from the right side to the left side (to the processing portion 10B) in the gap Ga. The feeding of the material to be processed is performed with the rotation of the inlet rotor 13*a* from the small diameter side having a slow peripheral velocity to the large diameter side having a fast peripheral velocity. The inclination of the outer peripheral surface of the inlet rotor 13*a* relative to the axis is set at approximately 45 degrees in this embodiment. This inclination angle is merely an example, and the inclination may be set at a different angle. Moreover, the gap Ga of the supply portion 10A is set to be greater than a gap Gt of the processing portion 10B described later.

The processing portion 10B comprises the processing portion rotor 11*b*, and the processing portion stator 12*b* that surrounds the processing portion rotor 11*b*. The processing portion rotor 11*b* is formed into a cylindrical shape and through which the rotational shaft 21 passes. Meanwhile, the processing portion stator 12*b* is formed into a cylindrical shape having an inner cavity 12*d*, and through which the processing portion rotor 11*b* is inserted. The gap Gt is made to be constant over the entire region in the circumferential direction and the entire region in the axial direction between the outer peripheral surface of the processing portion rotor 11*b* and the inner peripheral surface of the processing portion stator 12*b*. The gap Gt functions so as to perform the dispersion or grinding processing described later. The outer diameter of the processing portion rotor 11*b* and the outer diameter of the left end surface of the inlet rotor 13*a* are made to be the same. The outer diameter of the processing portion rotor 11*b* is set at, for example, between 10 and 1000 mm. A ratio (L/D) of the outer diameter D of the processing portion rotor 11*b* and the length L of the processing rotor 11*b* is preferably set, for example, within a range of 0.04 to 5.0, and more preferably within a range of 0.5 to 2.0 in order to further alleviate the following flaws. When the ratio (L/D) is smaller than 0.04, the length relative to the outer diameter is short, and it becomes difficult to apply appropriate shearing force for an appropriate time to the material to be processed, and the dispersion efficiency will thus deteriorate. Meanwhile, when the foregoing ratio (L/D) is greater than 5.0, it is difficult to maintain the constant gap Gt, and the internal pressure loss will increase, and dispersion/grinding cannot thus be performed appropriately.

Moreover, the gap Gt is set within the range of 10 μm to 1 mm. The reason why the gap Gt is limited at 10 μm or more is that when the gap Gt is less than 10 μm, there is a possibility that the processing portion rotor 11*b* and the processing portion stator 12*b* are likely to generate an abnormal heat. The lower limit may be preferably set at 50 μm or more in order to more reliably prevent the generation of abnormal heat. Meanwhile, when the gap Gt exceeds 1 mm, for example, the shearing stress (τ) in the known Petroffs equation will decrease, and it becomes difficult to perform the dispersion (or grinding) up to the intended level. The Petroffs equation is represented as shown in Formula (1) below.

$$\tau=\eta U/c \text{ (wherein } \eta\text{: viscosity, U: speed, and c: gap Gt)} \quad (1)$$

The shearing speed in the gap Gt is preferably set at, for example, 3000 to 600000 (l/s), and more preferably set within a range of 20000 to 500000. Specifically, the shearing speed is set by setting the rotating speed of the processing portion rotor 11*b* relative to the gap Gt. By setting the shearing speed within the foregoing range, it is possible to apply stable shearing force to the material to be processed from the initial stage of the processing, and stably perform the dispersion/grinding processing.

Moreover, the outer surface of the processing portion rotor 11*b* and the inner surface of the processing portion stator 12*b* are both formed to have a smooth surface that is free from unevenness. More specifically, the outer surface of the processing portion rotor 11*b* and the inner surface of the processing portion stator 12*b* are both formed to have a straight line that is parallel with the axis in the longitudinal section that passes the axis and a circle in the transverse section that perpendicularly intersects the axis. Thereby, the gap Gt can be made to be uniform over the entire region between the processing portion rotor 11*b* and the processing portion stator 12*b*. The radius of the processing portion rotor 11*b* and the processing portion stator 12*b* affects the dispersion processing speed, and the length of the processing portion rotor 11*b* and the processing portion stator 12*b* in the axial direction affects the dispersion processing time. The radius and the length in the axial direction may be experimentally selected according to the type of material to be processed, the ultimate processing level, and other factors.

Moreover, the processing portion rotor 11*b* and the processing portion stator 12*b* are formed, for example, of a material having a hard substance on the surface of a stainless steel. Nevertheless, the material for the processing portion rotor 11*b* and the processing portion stator 12*b* may be different from the foregoing material. The processing portion stator 12*b* may be formed with a cooling water path 16 in a solid part thereof to cool the processing portion stator 12*b* by the cooling water that passes through the cooling water path 16. The reference numeral 16*b* in FIG. 2 denotes an inlet for charging the cooling water, and reference numeral 16*c* denotes an outlet for discharging the cooling water.

The discharge portion 10C comprises the discharge portion rotor 11*c*, and the discharge portion stator 12*c* that surrounds the discharge portion rotor 11*c*, and is provide with a converging guide part 10C1 on the upstream side in the direction (horizontal direction) of feeding the material to be processed, and a feeding out part 10C2 on the downstream side. The diameter of the converging guide part 10C1 decreases as it approaches the discharge end, thereby performing a function of concentrating into spots the dispersed material having been subjected to the dispersion processing in the tubular space sandwiched between the rotor 11*b* and the stator 12*b* in the processing portion 10B. The converging guide part 10C1 includes a conical rotor 17 described later, and a guide member 30 that surrounds the conical rotor 17. The feeding out part 10C2, which is located on the downstream side of the converging guide part, is a portion that forcibly feeds out the processed material, and includes a screw rotor 18 described later, and an outlet stator 31 that surrounds the screw rotor 18.

The discharge portion rotor 11*c* includes the conical rotor 17 and the screw rotor 18 through both of which the rotational shaft 21 internally passes. In this embodiment, the outer diameter of the rotational shaft 21 is reduced according to the respective diameters of the conical rotor 17 and the screw rotor 18. However, the outer diameter of the rotational shaft 21 may be made to be constant over the entire axial length in consideration of the respective inner diameters of the rotors 11*a* to 11*c* of the portions 10A to 10C.

The conical rotor 17 has an outer peripheral surface having a tapered shape which is opposite to that of the inlet rotor 13*a*, that is, the right side is made to have a diameter larger than the left side, and the outer diameter of the right end of the conical rotor 17 coincides with the outer diameter of the processing portion rotor 11*b*. The inner diameter of the conical rotor 17 is constant, thereby rendering the conical rotor 17 to have an annular cross section. Since the outer peripheral surface of the conical rotor 17 is formed in the tapered shape opposite to that of the inlet rotor 13*a*, it does not have the function of feeding the processed material to the left side (outlet side). For this reason, the screw rotor 18 is provided to the left end of the conical rotor 17 so as to forcibly feed out the processed material having been conveyed up to the conical rotor 17 under the supply pressure and the centrifugal force generated by the rotation of the inlet rotor 13*a*.

The screw rotor 18 comprises a bar-shaped member 18*a* in which the rotational shaft 21 is inserted excluding the left discharging end and which has a circular outer peripheral surface, and a fin 18*b* spirally provided on the outer peripheral surface of the bar-shaped member 18*a*. The fin 18*b* is formed so as to discharge the processed material with the rotation of the screw rotor 18, that is, the fin 18*b* is formed into a spiral whose winding direction is a predetermined direction. The screw rotor 18 may be directly mounted on the rotational shaft 21, or may alternatively be mounted concentrically on the rotational shaft 21 by a way of different methods.

The discharge portion stator 12*c* is made of a plurality of members surrounding the outside of the discharge portion rotor 11*c*. More specifically, the discharge portion stator 12*c* comprises a guide member 30 that surrounds the conical rotor 17 and constitutes the converging guide part 10C1 together with the conical rotor 17, an outlet stator 31 that surrounds the screw rotor 18 and constitutes the feeding out part 10C2 together with the screw rotor 18, and a holding part 10C3 that holds the guide member 30 and the outlet stator 31 in an intended state. The holding part 10C3 includes three holding members 32, 33, 34 in this embodiment. The holding member 32 presses the guide member 30 toward the processing portion stator 12*b*, and restrains a right end part of the outlet stator 31. The holding member 33 restrains a left end part of the outlet stator 31, and the holding member 34 holds the holding member 33. The holding part 10C3 may be made of two or four or more members, or may be alternatively formed into a single body.

An inside of the guide member 30 is formed with an insertion hole 30*a* through which the conical rotor 17 is inserted, and the inner peripheral surface of the insertion hole 30*a* is formed into a similar shape to the outer peripheral surface of the conical rotor 17. A gap Gb for moving the processed material is formed over the entire region in the circumferential direction and the axial direction between the inner peripheral surface of the insertion hole 30*a* and the outer peripheral surface of the conical rotor 17. The gap Gb of the discharge portion 10C is set to be larger than the gap Gt of the processing portion 10B. The gap Gb of the discharge portion 10C does not need to be constant over the region along the axial direction of the conical rotor 17, but may vary at different locations.

Moreover, an inside of the outlet stator 31 is formed with an insertion hole 31*b* having a constant inner diameter for allowing the screw rotor 18 to be inserted. The inner diameter of the outlet stator 31 is set to be larger than the outer diameter of the fin 18*b*. The outlet stator 31 is made, for example, of the same material as the processing portion stator 12*b*, or of a different material. Moreover, the screw rotor 18 is made of a material for a screw used in injection molding or other material.

The outlet stator 31 is provided with a cooling mechanism 35 on an outside thereof. The cooling mechanism 35 is provided on the outside of the outlet stator 31, and comprises a cylindrical passage forming member 36 that forms a cooling water passage with the outlet stator 31, an inlet 36*a* provided on the passage forming member 36 for allowing the cooling water to be charged, and an outlet 36*b* provided on the passage forming member 36 for allowing the cooling water to be discharged.

Furthermore, an inside of the last arranged holding member 34 is formed with a through-hole 34*a* having the same inner diameter as the inner diameter of the outlet stator 31. The left side (other end) of the last arranged holding member 34 is provided with a discharge outlet 37 for discharging the processed material to the outside, and the processed material is discharged from the discharge outlet 37. The discharge outlet 37 constitutes the discharge portion 10C.

Contents of the dispersion processing performed by the dispersion machine 1 of this embodiment configured as described above are now explained.

The electric motor 23 is put into work to rotate the rotational shaft 21 and the rotating body 3. In this state, the material to be processed is supplied into the supply hole 14*b*. The supplied material reaches the recess 13*c*1 via the supply hole 14*b*. Subsequently, the material to be processed moves in the gap Ga between the inlet rotor 13*a* and the first region 14*a*1, and then reaches the processing portion 10B owing to the rotation of the inlet rotor 13*a* constituting the supply portion 10A, and other forces.

The material to be processed having been conveyed to the processing portion 10B moves in the gap Gt between the outer peripheral surface of the processing portion rotor 11*b* and the inner peripheral surface of the processing portion stator 12*b*, and dispersion processing is performed during this movement. In this process, as described above, the dispersion processing speed is affected by the radius of the processing portion rotor 11*b* and the processing portion stator 12*b*, and the dispersion processing time is affected by the axial length of the processing portion rotor 11*b* and the processing portion stator 12*b*.

The processed material having been subjected to the dispersion processing in the processing portion 10B is discharged outward from the discharge outlet 37 of the discharge portion 10C.

With the dispersion machine 1 of this embodiment that performs the dispersion processing as described above, upon the material to be processed being conveyed from the supply portion 10A to the processing portion 10B, the material to be processed is subjected to the dispersions/grinding processing in the gap Gt between the inner peripheral surface of the processing portion stator 12*b* and the outer peripheral surface of the processing portion rotor 11*b* of the processing portion 10B. Moreover, since the gap Gt is made to be constant in the circumferential direction and in the axial center direction of the processing portion rotor 11*b*, the viscosity of the material subjected to the dispersion processing is stabilized, and efficient dispersion processing is enabled.

Moreover, in this embodiment, since both the inner periphery of the processing portion stator 12*b* and the outer periphery of the processing portion rotor 11*b* in the processing portion 10B are made to be linear along the axis, it is possible to obtain a shearing force distribution having no gradient of shearing force. Since the material to be processed moves in such a shearing force distribution, an intended shearing force can be applied to the material to be processed by adjusting the diameter of the processing portion rotor 11*b*, and it is thereby possible to apply stable shearing force to the material to be processed. Furthermore, even when the material to be processed moves through different positions between the processing portion stator 12*b* and the processing portion rotor 11*b*, it is possible to suppress the difference in the applied shearing force, and thereby suppress variations in the dispersion processing. In addition, since the material to be processed is supplied from the supply portion 10A to the processing portion 10B, the supplied material to be processed is processed in the processing portion 10B, and the discharge portion 10C discharges the processed material, it is possible to continuously perform the dispersion processing. Moreover, it is possible to suppress the power consumption to a predetermined production volume. Furthermore, since a simple configuration in which the rotating body 3 is merely surrounded by the stators 12*a*, 12*b*, and 12*c* is adopted, the maintenance is easy, and the initial costs can also be reduced.

Moreover, in this embodiment, since the processing portion rotor 11*b* in the processing portion 10B is made to have the constant outer diameter along the axial direction, high efficiency processing is enabled over the entire region from the entry side end to the exit side end of the processing portion 10B. Meanwhile, in Patent Literature 1, the efficiency of dispersion or grinding processing increases as approaching the outer periphery of the disk-shaped grindstone, and it is impossible to constantly perform the high efficiency processing from the center to the outer periphery of the grindstone.

Furthermore, in this embodiment, since the discharge portion 10C comprises the screw rotor 18 and the outlet stator 31 that surrounds the screw rotor 18, the screw rotor 18 will forcibly discharge the material having been processed in the processing portion 10B, which consequently makes it possible to suppress prospective increase in the internal pressure in the processing portion 10B.

Furthermore, in this embodiment, since the supply portion 10A comprises the tapered inlet rotor 13*a* having the outer peripheral surface whose diameter is larger closer to the processing portion 10B than the inlet end of the supply portion 10A, and the inlet stator 14 that surrounds the inlet rotor 13*a*, in other words, both the outer diameter of the inlet rotor 13*a* and the inner diameter of the inlet stator 14 are made to be larger closer to the processing portion than the inlet end, the material to be processed can be more easily sucked into the processing portion 10B, and the material to be processed can be smoothly supplied to the processing portion 10B.

It is needless to say that the dispersion machine 1 of this embodiment can be used as a grinding machine for grinding a material to be processed.

The material to be processed has not been specified in the foregoing description. However, the following materials are specified as materials that can be subjected to the dispersion or grinding processing in the embodiment of the present invention.

(A) Materials for batteries such as lithium ion batteries;

(B) Coating materials for color filters and antireflection materials for use in FPD (flat panel displays) of liquid crystal TVs and the like;

(C) Materials for electronic components such as capacitors;

(D) Organic/inorganic materials (pigments) for paints and inks;

(E) Organic/inorganic materials (pigments) for coloring materials; and (F) Other organic/inorganic materials that are available in the market.

Here, the dispersion processing performed for the materials of foregoing (A) to (F) targets a mixture of a liquid and a liquid, a mixture of one or more types of liquids and one or more types of solids, a mixture of a solid and a solid, and so on. Here, with the mixture of a liquid and a liquid, one liquid is dispersed in the other liquid, with the mixture of one or more types of liquids and one or more types of solids, the solid is dispersed in the liquid, and with the mixture of a solid and a solid, one solid is dispersed in the other solid. Moreover, the grinding processing performed for the materials of foregoing (A) to (F) targets a mixture of one or more types of liquids and one or more types of solids, one or more types of solids, and so on. In this case, the processing is to grind a solid.

Furthermore, in the foregoing embodiment, the outer surface of the processing portion rotor 11*b* and the inner surface of the processing portion stator 12*b* of the processing portion 10B are both formed to have a smooth surface (linear in the longitudinal section) without irregularities. However, the mode of the present invention is not limited to this embodiment, and the outer surface of the processing portion rotor 11*b* and the inner surface of the processing portion stator 12*b* may be formed to have a smooth surface (liner in the longitudinal section) having smaller irregularities. The irregularities are regulated at such a level that the dispersion or grinding can be performed reliably even when the shearing force lowers in the considerable change of shearing force due to a variation in the gap Gt. In other words, minute irregularities may be formed in the outer surface of the processing portion rotor 11*b* and the inner surface of the processing portion stator 12*b* within the range assuring the operations. The irregularities may be formed into, for example, pointed recess and projection, or spiral recess and projection, or annular recess and projection.

Figure 3:
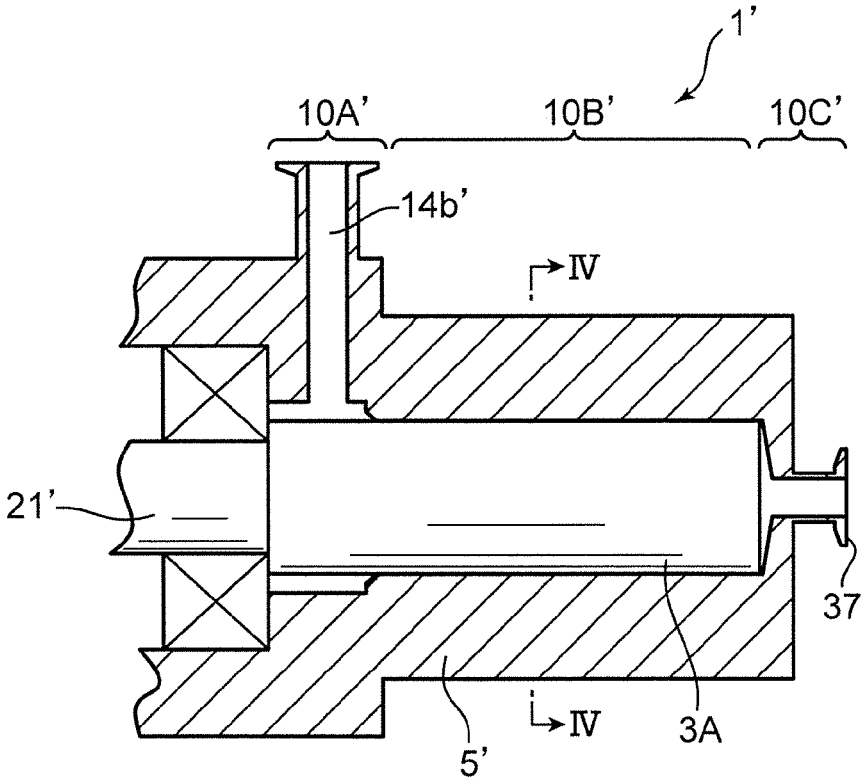
FIG. 3 is a frontal cross sectional view showing a main part of a dispersion and grinding machine according to another embodiment of the present invention.
Figure 4:
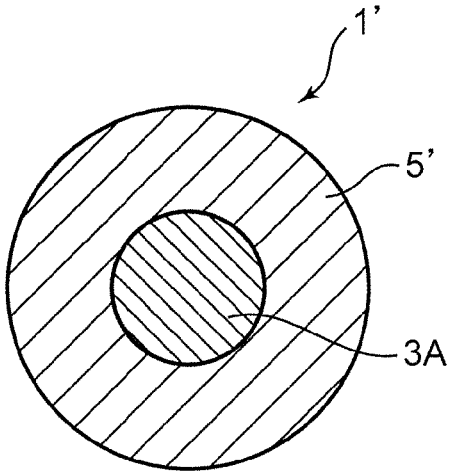
FIG. 4 is a cross sectional view taken along the line IV-IV in FIG. 3.

Furthermore, in the foregoing embodiment, the supply portion 10A includes the inlet rotor 13*a* having a tapered outer peripheral surface and the inlet stator 14 having a corresponding inner surface shape. However, according to the mode of the present invention, the configuration is not limited to the foregoing. For example, a configuration shown in FIG. 3 and FIG. 4 may be adopted. FIG. 3 is a frontal cross sectional view showing a main part of a dispersion machine according to another embodiment of the present invention, and FIG. 4 is a cross sectional view taken along the line IV-IV in FIG. 3. It should be noted that, in FIG. 3 and FIG. 4, an inlet side and an outlet side are shown in horizontally opposite sides to those shown in FIG. 1 and FIG. 2.

With this dispersion machine 1', a rotating body 3A is formed to have a constant diameter from a supply portion 10A' to a discharge portion 10C', and a stator 5' is also formed to have a substantially constant inner diameter. The supply portion 10A' is provided with a supply hole 14*b*' extending in a direction intersecting an axis of the rotating body 3A to supply a material to be processed to a peripheral surface of the rotating body 3A. Moreover, the discharge portion 10C' is constituted by only the stator 5' without include the rotating body 3A, and has an inner cavity whose diameter decreases steeply as the inner peripheral surface of the stator 5' approaches a discharge side. With this dispersion machine 1', in order to convey the material to be processed in the processing portion 10B', it is necessary to apply pressure to push the material to be processed to the rotating body 3A in the supply portion 10A', or forcibly feed the material to be processed to the rotating body 3A side with a screw feeder or a liquid feeding pump (neither are shown). The screw feeder is used when the material to be processed is a solid, and the liquid feeding pump is used when the material to be processed is a liquid or contains a liquid. In FIG. 3, reference numeral 21' denotes a rotational shaft corresponding to the rotational shaft 21.

Figure 5:
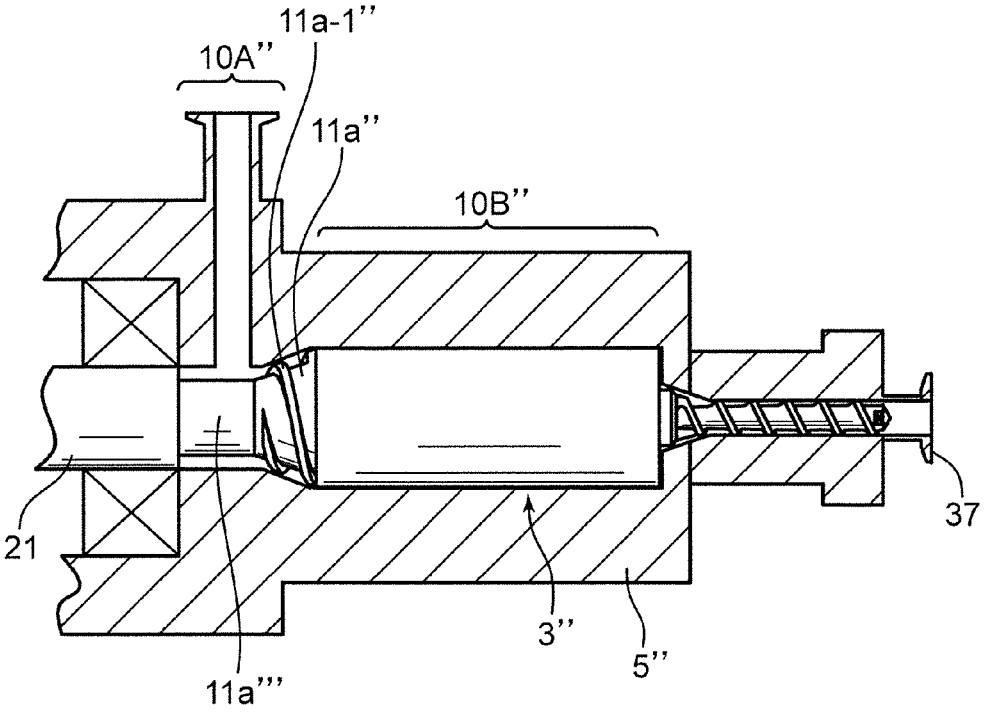
FIG. 5 is a frontal cross sectional showing a main part of a dispersion and grinding machine according to yet another embodiment of the present invention.

Furthermore, according to the mode of the present invention, as shown in FIG. 5, a spiral fin 11*a*-1" may be provided on an outer peripheral surface of an inlet rotor 11*a*" of a supply portion 10A". In this case, since the material to be processed is forcibly supplied from the supply portion 10A" to a processing portion 10B" with the rotation of the fin 11*a*-1", stable supply of the material to be processed to the processing portion 10B" is enabled. In this case, a rotary driver may include an existing rotor rotating mechanism (endless belt 24, electric motor 23 or the like). In FIG. 5, a fin 11*a*-1" is provided on a tapered outer peripheral surface of an inlet rotor 11*a*". According to the mode of the present invention, the configuration is not limited to the foregoing. For example, a spiral fin 11*a*-1" may be provided on an outer peripheral surface of a rotating part 11*a*'" which is located on the left side of the inlet rotor 11*a*" and has a constant outer diameter. Otherwise, a spiral fin 11*a*-1" may be provided on both the inlet rotor 11*a*" having the tapered outer peripheral surface and the rotating part 11*a*'" having the constant outer diameter. The rotating part 11*a*'" may be provided as an extending part of the inlet rotor 11*a*" or an extending part of the rotational shaft 21. In FIG. 5, reference numeral 3" denotes a rotating body, and reference numeral 5" denotes a stator.

Further, the endless belt 24 may be replaced with a gear. In this case, a gear mechanism including a plurality of transmission gears is provided between an output shaft 23*a* of an electric motor 23 and a rotational shaft 21. Otherwise, the rotational shaft 21 and the output shaft 23*a* of the electric motor 23 may be directly coupled by a way of direct coupling.

Furthermore, in the foregoing embodiment, the processing portion 10B is provided with the processing portion rotor 11*b* having the constant outer diameter. However, according to the mode of the present invention, the configuration is not limited to the foregoing. It may be appreciated to adopt a rotor whose outer diameter changes at a fixed ratio relative to the axis, that is, a rotor having a tapered outer peripheral surface. In this case, the smaller diameter end of the rotor having the tapered outer peripheral surface may be disposed either on the inlet side or the outlet side. The inclination of the outer peripheral surface of the rotor having a tapered outer peripheral surface relative to the axis is preferably set at, for example, 10 degrees or less. Nevertheless, the gap Gt between the rotor and the stator of the processing portion 10B is constant in the axial direction. In other words, the gap Gt is held to be constant in the axial direction, the inner periphery of the stator and the outer periphery of the rotor in the processing portion 1B may both be made to be a circle in a cross section orthogonally intersecting the axis of the rotor, and to be linear in a cross section bearing the axis. In the case of using such a rotor as having a tapered outer peripheral surface, both the inner periphery of the stator and the outer periphery of the rotor incline relative to the axis, a shearing force distribution having a smaller gradient of shearing force can be obtained. A material to be processed will move in the foregoing shearing force distribution. Accordingly, an intended shearing force can be applied to the material to be processed by adjusting the diameter of the rotor, and it is thereby possible to apply stable shearing force to the material to be processed.

Figure 6:
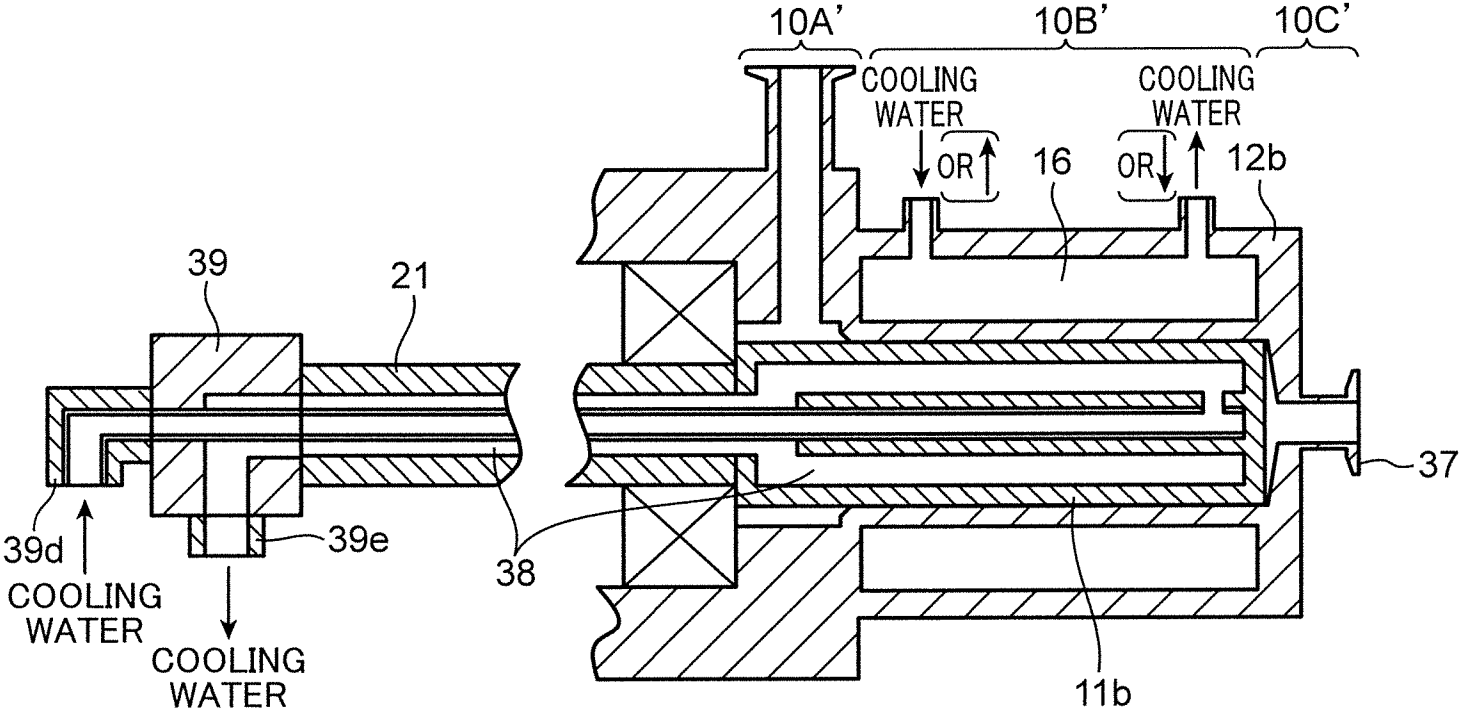
FIG. 6 is a frontal cross sectional view showing a main part of a dispersion and grinding machine according to still yet another embodiment of the present invention.

Furthermore, in the foregoing embodiment, the processing portion stator 12*b* is provided with the cooling water passage 16, but the processing portion rotor 11*b* is not provided with cooling means. However, according to the mode of the present invention, the configuration is not limited to the foregoing. As shown in FIG. 6, a processing portion rotor 11*b* may be provided with cooling means. Specifically, a cooling water passage 38 is formed in the processing portion rotor 11*b* and in a rotational shaft 21 for imparting a rotating force to the processing portion rotor 11*b*, and a water supply and drainage member 39 is provided on the opposite end of the rotational shaft 21 to the processing portion rotor 11*b*. The water supply and drainage member 39 is maintained at a fixed posture irrespective of the rotation of the rotational shaft 21. Cooling water is supplied to the cooling water passage 38 through a water supply port 39*d* provided in the water supply and drainage member 39, and discharged from the cooling water passage 38 through a water drainage port 39*e* provided in the water supply and drainage member 39. In FIG. 6, the same reference numerals are given to similar components to those shown in FIG. 3. Moreover, according to the mode of the present invention, the cooling mechanism may be omitted from at least one of the processing portion stator 12*b* and the processing portion rotor 11*b*.

The specific embodiments described above mainly include the mode of the present invention having the following configurations.

A dispersion and grinding machine according to one mode of the present invention comprises a supply portion for supplying a material to be processed, a processing portion for subjecting the material to be processed, which is supplied by the supply portion, to dispersion or grinding processing, and a discharge portion for discharging, from the processing portion, the material that has been processed by the processing portion, wherein the processing portion includes a stator having an inner cavity, and a rotor provided in the inner cavity and rotatable about an axis of the stator, and the material to be processed being processed in a gap between an outer peripheral surface of the rotor and an inner peripheral surface of the stator, the inner peripheral surface facing the outer peripheral surface of the rotor, wherein the inner peripheral surface of the stator and the outer peripheral surface of the rotor are circular in a cross section orthogonally intersecting the axis of the rotor, and linear in a cross section bearing the axis, and the gap between the inner peripheral surface of the stator and the outer peripheral surface of the rotor is constant in the circumferential direction and the axial direction.

With the foregoing configuration, it is possible to suppress variations in the dispersion/grinding processing, and to apply stable shearing force to the material to be processed, which makes it possible to perform the more efficient dispersion/grinding.

In the foregoing configuration, preferably, the outer peripheral surface of the rotor and the inner peripheral surface of the stator in the processing portion both have a smooth surface. Accordingly, it is possible to make the gap between the stator and the rotor to be more uniform in different locations.

In the foregoing configuration, preferably, the discharge portion includes a screw rotor for conveying the material that has been processed by the processing portion, and an outlet stator that surrounds the screw rotor. Accordingly, the screw rotor can forcibly discharge the material processed in the processing portion, and it is thus possible to suppress the increase in the internal pressure of the processing portion.

In the foregoing configuration, preferably, the supply portion includes an inlet rotor having a tapered peripheral surface whose diameter is larger in processing portion side than in the supply portion inlet side, and an inlet stator that surrounds the inlet rotor. Since the outer diameter of the inlet rotor and the inner diameter of the inlet stator are both formed to be larger on the processing portion side than the inlet side, the material to be processed can be more easily sucked into the processing portion side, and the material to be processed can be smoothly supplied to the processing portion.

In the foregoing configuration, preferably, the supply portion comprises an inlet rotor having a spiral fin on an outer peripheral surface thereof to supply the material to be processed to the processing portion. Since the fin forcibly supplies the material to be processed to the processing portion, the material to be processed can be stably supplied to the processing portion.

In the foregoing configuration, preferably, the rotor in the processing portion has a constant outer diameter along the axial direction. Accordingly, high efficiency processing can be performed at the inlet of the processing portion. In other words, in the case of Patent Literature 1, the efficiency of dispersion or grinding processing rises as the processing approaches the outer periphery of the disk-shaped grindstones. In the foregoing configuration of the present invention, high efficiency dispersion/grinding processing can be performed in all regions from the inlet end to the outlet end of the processing portion.

The invention claimed is:

1. A dispersion and grinding machine comprising a supply portion for supplying a material to be processed, a processing portion for subjecting the material to be processed, which is supplied by the supply portion, to dispersion or grinding processing, and a discharge portion for discharging, from the processing portion, the material that has been processed by the processing portion, wherein the processing portion includes a stator having an inner cavity with an inner peripheral surface, and a rotor provided in the inner cavity and rotatable about an axis of the stator, and the material to be processed being processed in a gap between an outer peripheral surface of the rotor and the inner peripheral surface of the stator, the inner peripheral surface facing the outer peripheral surface of the rotor, wherein the inner peripheral surface of the stator and the outer peripheral surface of the rotor are concentrically circular in a cross section orthogonally intersecting the axis of the rotor, and linear in a cross section bearing the axis, and the gap between the inner peripheral surface of the stator and the outer peripheral surface of the rotor is constant in the circumferential direction and the axial direction, wherein the discharge portion includes a screw rotor for conveying the material that has been processed by the processing portion, an outlet stator that surrounds the screw rotor and includes an insertion hole having a constant inner diameter, and a holding part that holds the outlet stator and has a discharge outlet for discharging the processed material to the outside, the screw rotor being formed with a fin in such a way as to forcibly discharge the processed material with a rotation of the screw rotor, the discharge outlet of the holding part having the same diameter as the insertion hole of the outlet stator, and wherein the rotor of the processing portion and the screw rotor of the discharge portion are integrated with each other with their respective axes being aligned and extending in a horizontal direction, the dispersion and grinding machine further comprising:

a single rotating driver for drivingly rotating the rotor and the screw rotor.

2. The dispersion and grinding machine according to claim 1, wherein the outer peripheral surface of the rotor and the inner peripheral surface of the stator in the processing portion both has a smooth surface.

3. The dispersion and grinding machine according to claim 1, wherein the supply portion includes an inlet rotor having a tapered peripheral surface whose diameter is larger in the processing portion side than in the supply portion inlet side, and an inlet stator that surrounds the inlet rotor.

4. The dispersion and grinding machine according to claim 1, wherein the supply portion comprises an inlet rotor having a spiral fin on an outer peripheral surface thereof to supply the material to be processed to the processing portion.

5. The dispersion and grinding machine according to claim 4, wherein the rotor in the processing portion has a constant outer diameter along the axial direction.

6. The dispersion and grinding machine according to claim 2, wherein the supply portion includes an inlet rotor having a tapered peripheral surface whose diameter is larger in the processing portion side than in the supply portion inlet side, and an inlet stator that surrounds the inlet rotor.

7. The dispersion and grinding machine according to claim 2, wherein the supply portion comprises an inlet rotor having a spiral fin on an outer peripheral surface thereof to supply the material to be processed to the processing portion.

8. The dispersion and grinding machine according to claim 6, wherein the rotor in the processing portion has a constant outer diameter along the axial direction.

9. The dispersion and grinding machine according to claim 7, wherein the rotor in the processing portion has a constant outer diameter along the axial direction.

10. The dispersion and grinding machine according to claim 3, wherein the rotor in the processing portion has a constant outer diameter along the axial direction.

* * * * *